US005975996A

United States Patent [19]

Settles

[11] Patent Number: 5,975,996

[45] Date of Patent: Nov. 2, 1999

[54] ABRASIVE BLAST CLEANING NOZZLE

[75] Inventor: Gary S. Settles, Bellefonte, Pa.

[73] Assignee: The Penn State Research Foundation, University Park, Pa.

[21] Appl. No.: 08/896,252

[22] Filed: Jul. 17, 1997

Related U.S. Application Data

[60] Provisional application No. 60/022,216, Jul. 18, 1996.

[51] Int. Cl.[6] ..... B24C 5/04

[52] U.S. Cl. ..... 451/102; 239/589; 239/590.5

[58] Field of Search ..... 451/102, 38, 39; 239/589, 590.5

[56] References Cited

U.S. PATENT DOCUMENTS

| | | | |
|---|---|---|---|
| 1,751,719 | 3/1930 | Uhri . | |
| 2,879,003 | 3/1959 | Finn . | |
| 3,906,672 | 9/1975 | Kobayashi | 451/102 |
| 4,134,542 | 1/1979 | Sugiura . | |
| 4,253,610 | 3/1981 | Larkin . | |
| 4,478,368 | 10/1984 | Yie . | |
| 4,631,871 | 12/1986 | Saunders | 451/102 |
| 5,319,894 | 6/1994 | Shank . | |
| 5,421,776 | 6/1995 | Sakamoto . | |
| 5,484,325 | 1/1996 | Shank . | |
| 5,545,073 | 8/1996 | Kneisel . | |

FOREIGN PATENT DOCUMENTS

| | | | |
|---|---|---|---|
| 404261776 | 9/1992 | Japan | 451/102 |
| 722464 | 1/1955 | United Kingdom | 451/102 |

OTHER PUBLICATIONS

"Redesigning Blasting Nozzles to Improve Productivity", Gary S. Settles and Stephen T. Geppert, Journal of Protective Coatings and Linings, Oct. 1996, vol. No. 10, pp. 64–72.

"A Scientific View of the Productivity of Abrasive Blasting Nozzles", Gary S. Settles and Sanjay Garg, Research News, vol. 12, No. 4, Apr. 1995, pp. 28–41, 101–102.

*Primary Examiner*—Robert A. Rose
*Assistant Examiner*—George Nguyen
*Attorney, Agent, or Firm*—Thomas J. Monahan

[57] ABSTRACT

A nozzle for an abrasive blast cleaning apparatus consisting of a short, relatively rapidly converging inlet section, a constant-area throat, a rapidly diverging first diverging section, and a long second diverging section that diverges less rapidly than the first diverging section. The inlet section quickly accelerates the abrasive particles after entering the nozzle, while the first diverging section rapidly brings the relative velocity of the air stream and the abrasive particles to about Mach 1.4. The second diverging section helps to maintain the relative Mach number while the abrasive particles continue to accelerate. This makes abrasive blast cleaning more efficient, particularly because the kinetic energy of the abrasive particles emerging from the nozzle is significantly increased.

28 Claims, 6 Drawing Sheets

| x | r | x | r |
|---|---|---|---|
| mm | mm | mm | mm |
| 0 | 15.88 | 77 | 6.55 |
| 5 | 14.84 | 78 | 6.65 |
| 10 | 13.81 | 79 | 6.75 |
| 15 | 12.77 | 80 | 6.83 |
| 20 | 11.75 | 81 | 6.90 |
| 25 | 10.72 | 82 | 6.95 |
| 30 | 9.68 | 83 | 7.00 |
| 35 | 8.65 | 84 | 7.05 |
| 40 | 7.62 | 85 | 7.10 |
| 45 | 6.60 | 86 | 7.14 |
| 46 | 6.42 | 87 | 7.17 |
| 47 | 6.25 | 88 | 7.20 |
| 48 | 6.10 | 89 | 7.21 |
| 49 | 5.96 | 90 | 7.22 |
| 50 | 5.84 | 91 | 7.23 |
| 51 | 5.71 | 92 | 7.24 |
| 52 | 5.65 | 93 | 7.25 |
| 53 | 5.62 | 94 | 7.26 |
| 54 | 5.60 | 95 | 7.27 |
| 55 | 5.57 | 100 | 7.31 |
| 56 | 5.56 | 125 | 7.55 |
| 67 | 5.56 | 150 | 7.79 |
| 68 | 5.58 | 175 | 8.02 |
| 69 | 5.63 | 200 | 8.26 |
| 70 | 5.70 | 225 | 8.50 |
| 71 | 5.80 | 250 | 8.73 |
| 72 | 5.95 | 275 | 8.97 |
| 73 | 6.08 | 300 | 9.20 |
| 74 | 6.20 | 325 | 9.44 |
| 75 | 6.33 | 345 | 9.63 |
| 76 | 6.45 | | |
| | | NOZZLE EXIT | |

FIG. 7

ABRASIVE BLAST CLEANING NOZZLE

This application claims the benefit of U.S. Provisional application Ser. No. 60/022,216, filed Jul. 18, 1996.

FIELD OF THE INVENTION

The present invention relates to nozzles, and particularly, to nozzles used in an abrasive blast cleaning apparatus.

DESCRIPTION OF RELATED ART

A converging-diverging nozzle configuration with a minimal throat area was generally described in 1888 by C. G. P. de Laval of Sweden, for use in connection with steam turbines. Then, in the field of abrasive blast cleaning, constant-area or straight-bore nozzles were primarily used up until the 1950s (see, for example, FIG. 1*a*). Then, British patent No. 722,464 of Mead disclosed a abrasive blast cleaning nozzle with a converging-diverging configuration. The general configuration of the Mead nozzle is illustrated herein in FIG. 1*b*.

Most current abrasive blast cleaning nozzles utilize the Laval-type configuration, although they are frequently, (and mistakenly), known as "Venturi" nozzles (which term is intended to only refer to nozzles associated with low-speed fluids).

A conventional example of a Laval-type nozzle is a "long-venturi" nozzle, as illustrated in FIG. 1*c*. Its interior contour is illustrated in FIG. 2*a*, and is graphically represented in FIG. 2*a*. In general, the configuration of the long-venturi nozzle is similar to that disclosed in the Mead patent mentioned above. This type of nozzle is commonly used in abrasive blast cleaning of all types, especially including steel structures, such as bridges and the like, to remove paint and corrosion.

Sand was once commonly used as the abrasive particulate matter for cleaning, but this caused medical problems for workers, such as silicosis caused by inhaled sand particles. Metal particles are therefore more commonly used now, such as 40-mesh or 50-mesh steel grit.

As illustrated in FIGS. 1*c* and 2 the long-venturi nozzle includes a conical converging section 2, an extended constant-area throat 4, and a conical, constantly-diverging section 6. The throat of the long-venturi nozzle has a 7/16" diameter, from which the designation "#7" is obtained. Other types of long venturi nozzles have a generally similar configuration to that shown in FIGS. 1*c*, 2*a*, and 2*b* while having varying throat diameters, for example, as small as 3/16" inch ("#3 nozzle") and as large as ¾ (i.e., 12/16" inch) ("#12 nozzle"). In general, the inlet diameter of this type of nozzle is 1.25" (about 31.8 mm).

A significant problem associated with the long-venturi nozzle is that it is remarkably inefficient with regard to the transfer of energy from the compressed airstream flowing through the nozzle to the abrasive particles entrained therein. This energy transfer efficiency is typically only on the order of about 10%. See, for example, "A Scientific View of the Productivity of the Abrasive Blasting Nozzles," *Journal of Protective coatings and Linings*, April 1995, pages 28–41 and 101–102, by the instant inventor and S. Garg, which is incorporated herein by reference.

In order to establish the level of performance of conventional blasting technology, a commercially available #7 long-venturi nozzle was incorporated into an experimental apparatus designed to measure the exit speed of a 40-mesh steel grit particulate stream. This measurement was obtained using the conventional technique of streak imaging, wherein images of the particles exiting from the nozzle were captured on a video tape using an electronic camera with a controlled exposure time period. With a known exposure time, the length of the streaks formed by the abrasive particles in the video image permits determination of their exit speed.

In these experiments, the nozzle was operated with an upstream pressure of 100 psig (793 kPa). Three different rates of particle mass flux, compared to the mass flux of airflow through the nozzle, were considered. At one extreme, a particle/air mass flux ratio much less than unity was used, while at the other extreme the particle mass flux was essentially comparable to the mass flux of the air passing through the nozzle.

After a statistically significant number of measurements, it was determined that the 40-mesh steel grit particle exit speed from the #7 long-venturi nozzle was, on average, 133 m/s, and was notably not dependent upon the mass flux ratio. This indicates that collisions of particles with the nozzle walls are not significant for the considerations herein.

Thereafter, a mathematical model was devised which represents a single 40-mesh steel grit particle travelling down the center line of the nozzle, integrating the drag force upon it and yielding a prediction of the particle velocity at the nozzle exit. Using the nozzle contour as shown in FIGS. 1*c* and 2, one-dimensional gas dynamic theory (e.g., NACA Report No. 1135) was used to find the airflow properties throughout the #7 long-venturi blasting nozzle. Then, the following equation was used to find the aerodynamic drag force on a theoretical particle:

$$F_{drag}=\text{Area}\times C_d\times(1/2)\rho(V_{re1})^2 \quad (1)$$

wherein Area is the particle cross-sectional area, $V_{re1}$ is the relative velocity between the particle and the air, $\rho$ is the local gas density, and $C_d$ is the drag coefficient of the particle. For simplicity, it was assumed that 40-mesh steel grit particles were spherical, with an average diameter of 817 micrometers (calculated from measurements of actual particle sizes), and with a specific gravity of 7.

The drag coefficient of these equivalent spherical particles was then obtained from empirical data originally complied by Bailey and Hiatt (1972).

The calculated exit velocity was 124 m/s, or about 7% lower than the measured value. This is considered to be good agreement between actual and calculated values, especially since the drag coefficient of an actual irregularly-shaped grit particle is expected to be higher than that of the theoretically equivalent sphere.

The velocity of the steel grit is graphically illustrated in FIG. 3, relative to axial position along the conventional #7 long-venturi nozzle. The velocity of the propelling gas (i.e., air) is also graphically indicated.

It can be appreciated from FIG. 3 that the exit velocity of the air is more than 4.5 times that of the steel grit. In addition, it can seen that the converging section of the nozzle contributes very little to the acceleration of the steel grit particles.

Since kinetic energy is proportional to the square of velocity, the kinetic energy of the steel grit particles exiting the nozzle is about 5% that of the air stream at equal air and steel grit mass flow rates. Thus, 95% of the kinetic energy of the air stream is being lost.

Considering Equation 1, it can be understood why the converging portion of the nozzle contributes little to the acceleration of the steel grit particles—the square of the relative velocity between the air stream and the steel grit is negligible here since the relative velocity between the two is low.

Equation 1 also suggests that $C_d$ and $(V_{rel})^2$ should be maximized in order to maximize drag on the steel grit particles. It should be remembered that, while drag is sometimes seen as a negative factor, here it is critical to accelerating the steel grit particles.

By way of illustration, FIG. 4*a* illustrates a given particle P in a supersonic air stream. Intuitively, it can be appreciated that if the particle moves through still air at a given velocity, a drag force F arises in a direction opposite to the direction of the particle's motion. In this simple example, the relative velocity between the still air and the particle is simply the velocity of the particle. The drag force therefore retards the motion of the particle.

However, when a particle moves with, but slower than, an air stream, the relative velocity between the air stream and the particle (the difference between the air stream velocity and the particle velocity) is reduced as the particle accelerates. This lowers the drag force on the particle, since the $(V_{rel})^2$ term is smaller. However, since the particle is moving in the same direction as the airstream, the drag force $F_{drag}$ acts in the direction of particle travel, and therefore causes the particle to accelerate, instead of decelerate.

Thus, by increasing the relative velocity between the air stream and the particle, the drag force F increases, and the particle is more strongly accelerated.

From empirical data, e.g., Bailey and Hiatt (1972), the drag coefficient increases as a function of Mach number, up to approximately Mach 1.4. FIG. 4*b* illustrates this relationship between drag coefficient $C_d$ and Mach Number. Furthermore, gas dynamic theory shows that dynamic pressure, $\frac{1}{2}\rho(V_{rel})^2$, is also maximized at a relative Mach number of approximately 1.4 for a fixed stagnation pressure.

It should be noted here, however, that the dynamic pressure is within 10% of its maximum over the range between Mach 1.07 and Mach 1.84, and the present invention is useful over this entire range. Furthermore, reference to "approximately Mach 1.4" and the like is contemplated as including this range of Mach number values.

SUMMARY OF THE PRESENT INVENTION

In view of the foregoing, it is an objective of the present invention to provide a nozzle for use in abrasive blast cleaning that provides significantly increased efficiency in energy transfer from the compressed airstream to the abrasive particles being used. An object of the present invention is to double the productivity of abrasive blast cleaning using a 100 psig input hose pressure and 40-mesh steel grit (both of which are largely standard in the field), compared to prior art nozzle technology. It is known that increasing hose pressure or decreasing grit size leads to increased productivity. However, it is a goal of the present invention to increase productivity while requiring as little change as possible to existing systems, by relying entirely upon the improved nozzle design described herein.

By way of example, it has been estimated that an "average" job of abrasive blast cleaning a bridge involves 50,000 to 80,000 square feet needing to be cleaned. Assuming 1,500 bridges are repainted (and correspondingly blast cleaned) each year, the total area being worked is on the order of 30 to 72 million square feet. By doubling cleaning productivity using the present invention, the savings to the coatings removal industry could be as much as $100 million each year.

In particular, by providing a nozzle with improvements in internal contour and length, typical particle speed at the nozzle exit may be increased by 40% or more above that of the conventional long-venturi nozzle illustrated in FIG. 1*c*. Accordingly, this approximately doubles the overall kinetic energy of the abrasive particle stream while maintaining the same mass flow rates of both the compressed air and the abrasive particles. The doubled kinetic energy of the abrasive particle stream doubles the amount of work done by the abrasive particle stream on the surface being blast cleaned. As a result, approximately a doubling of the overall productivity of the blast cleaning operation is obtained.

It is a further beneficial aspect of the present invention that merely providing a nozzle having improved design can bring about the foregoing advantages, without requiring any other changes in blasting equipment, abrasive, or operational blasting pressures, thereby facilitating the realization of the advantages of the present invention.

Therefore, a nozzle according to the present invention characteristically includes:

- a short (in an axial sense) inlet section having a non-critical shape, in order to quickly begin significant acceleration of the particles after entering the nozzle;
- a short, constant-area throat, the axial length of which is the minimum necessary to avoid excessive throat wear during the life of the nozzle;
- a rapidly diverging section that opens to a diameter sufficient to bring the relative velocity between the air stream and the abrasive particles to approximately Mach 1.4;
- a long, gradually diverging section for increasing the airspeed in the nozzle while the abrasive particles are accelerating, assuming frictionless flow, so that the relative velocity remains approximately Mach 1.4; and
- an overall length that is substantially longer, within practically reasonable limits, than the traditional long-venturi nozzle, in order to increase the exit speed of the abrasive particles by the greatest practical amount.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 7 is a table of radius vs. axial length values for a nozzle according to the present invention.

DETAILED DESCRIPTION OF THE PREFERRED EMBODIMENT(S)

The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will be described hereinbelow with reference to the drawings appended hereto.

Figure 1A:
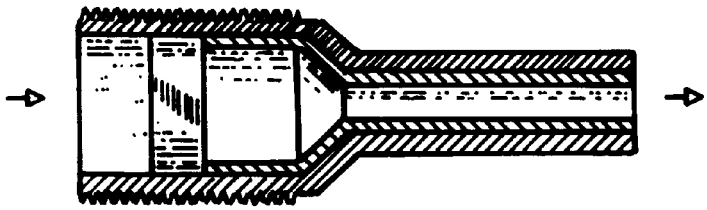
FIG. 1A PRIOR ART
FIG. 1*a* is an illustration of a conventional straight bore nozzle used in abrasive blast cleaning prior to the 1950s.
Figure 1B:
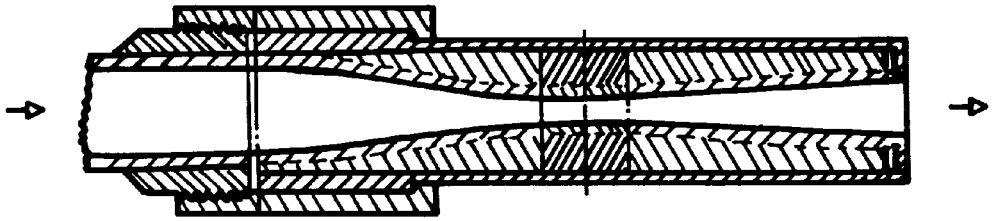
FIG. 1B PRIOR ART
FIG. 1*b* is a cross section of Mead's (British Patent 722,464) nozzle.
Figure 1C:
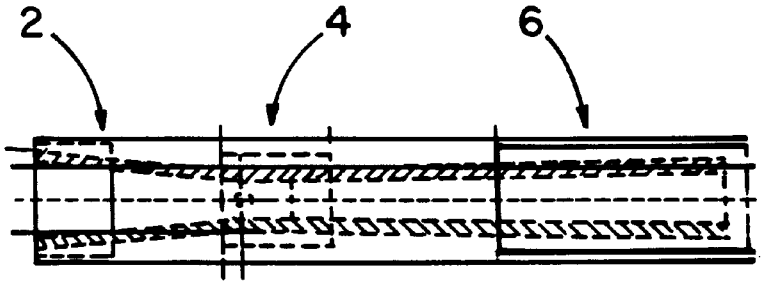
FIG. 1C PRIOR ART
FIG. 1*c* is a cross section of a present-day long-venturi nozzle used in abrasive blast cleaning.
Figure 2:
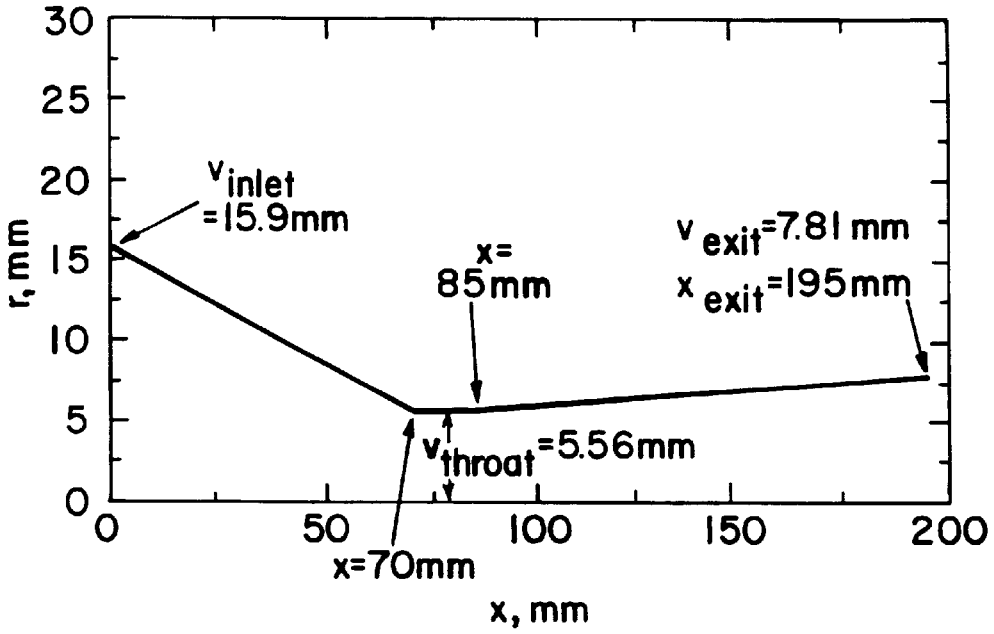
FIG.2 PRIOR ART
FIG. 2 is a graphical representation of the internal contour of the conventional #7 long-venturi nozzle illustrated in FIG. 1*c;*
Figure 3:
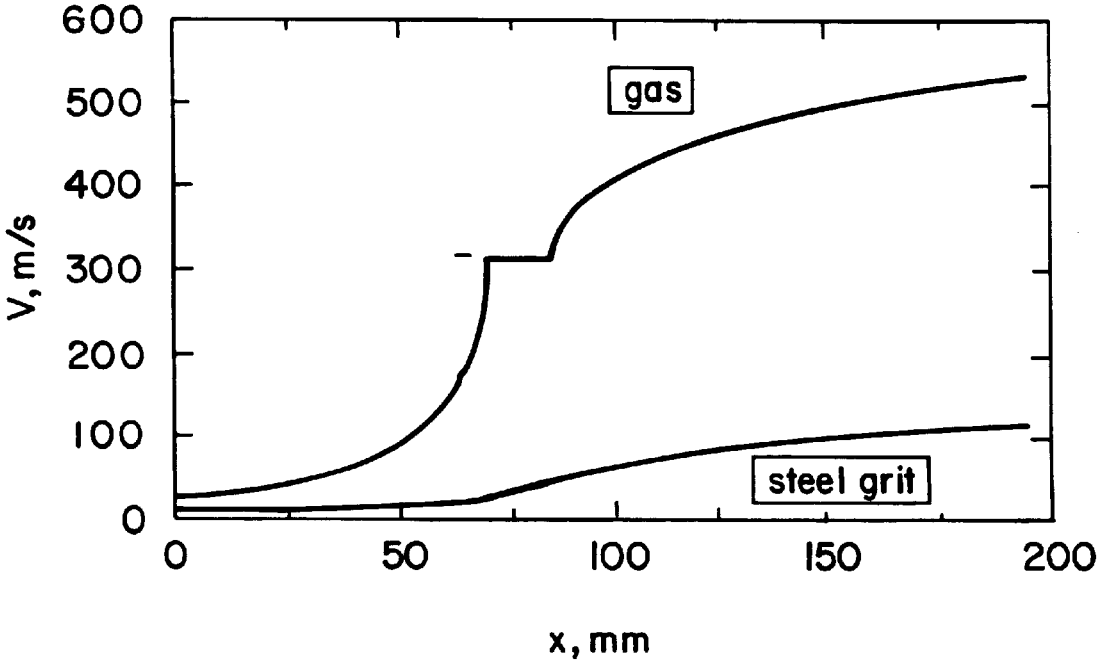
FIG.3 PRIOR ART
FIG. 3 is a graphical representation of the velocity of a gas stream and a metal particle through the conventional #7 long-venturi nozzle.
Figure 4A:
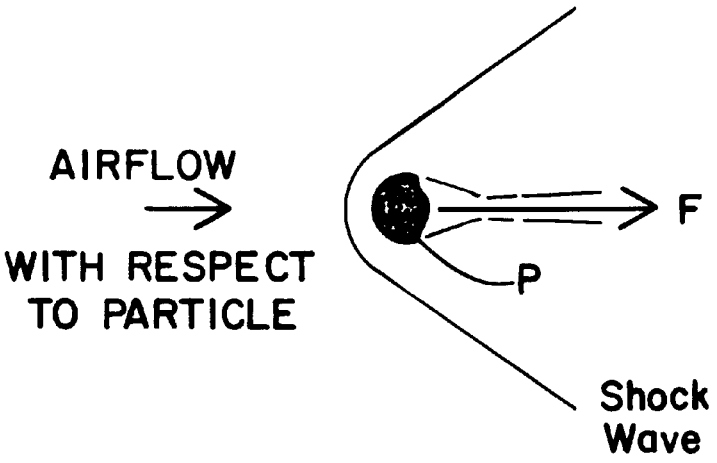
FIG. 4*a* illustrates how drag force can accelerate a particle in an airstream.
Figure 4B:
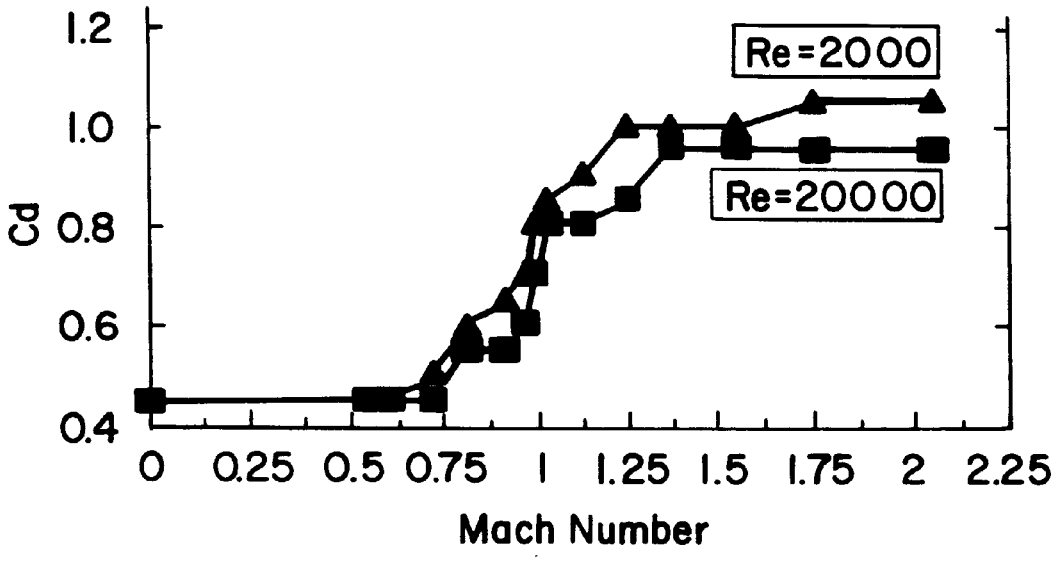
FIG. 4B PRIOR ART
FIG. 4*b* illustrates a relationship between sphere drag coefficient versus Mach number for varying Reynolds numbers.
Figure 5A:
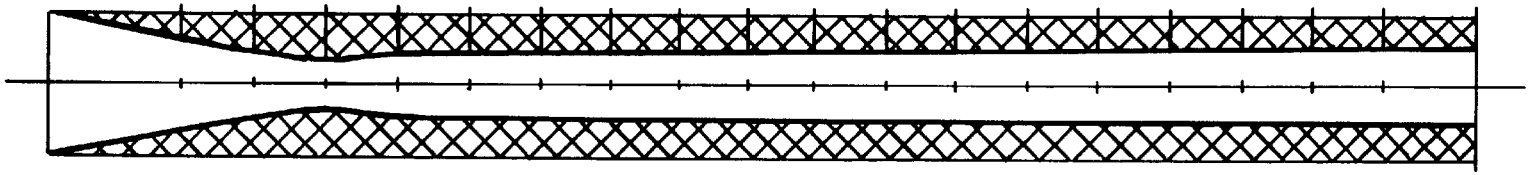
FIG. 5*a* is a schematic cross sectional view of the nozzle according to the present invention.
Figure 5B:
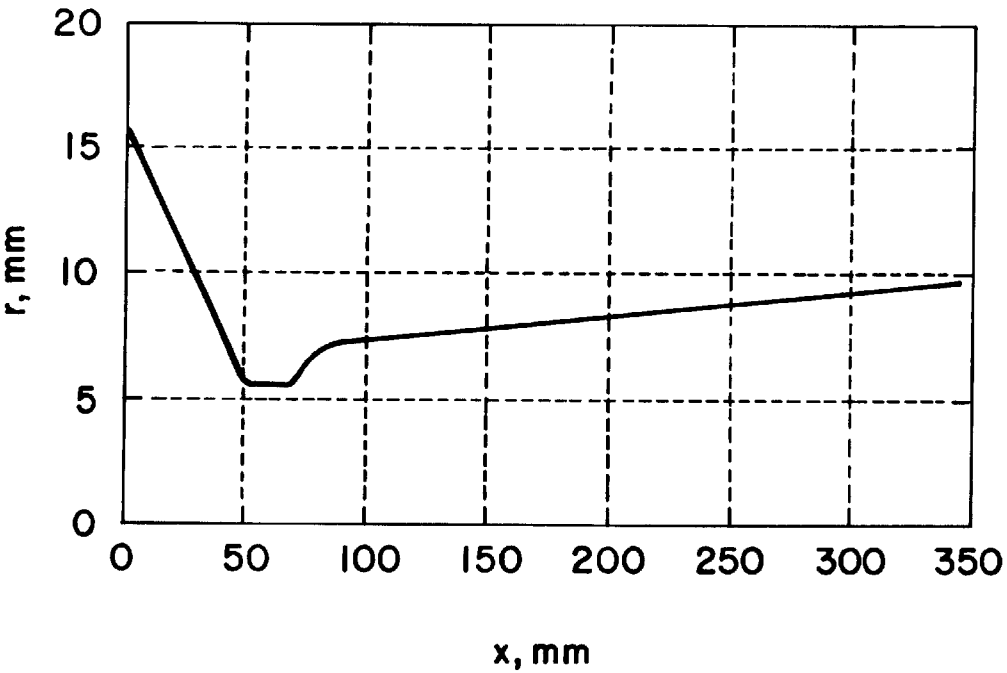
FIG. 5*b* is a graphical representation of the internal contour of the nozzle according to the present invention, as illustrated in FIG. 5*a;*
Figure 6:
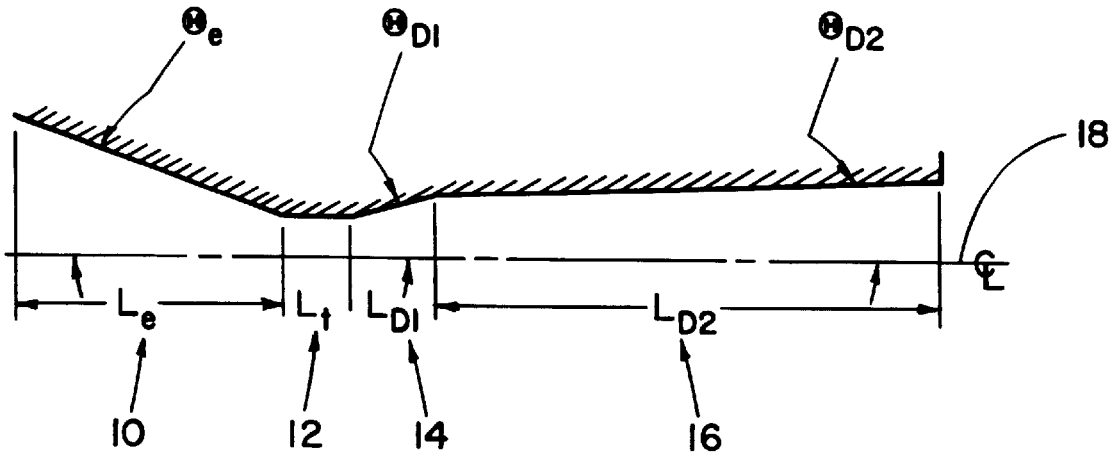
FIG. 6 illustrates certain dimensional parameters of the nozzle according to the present invention.

FIG. 5*a* is a schematic cross-sectional view of a nozzle arrived at according to the aforementioned considerations. FIG. 5*b* is a corresponding graphical representation of the internal dimensions of the nozzle according to the present invention, wherein the scale of the radius r axis has been distortively enlarged in order to make the representation more clear. FIG. 6 is a cross-sectional schematic view in which certain dimensional parameters are shown. The preferred ranges of values for the parameters identified in FIG. 6 are tabulated in Table 1, below.

TABLE 1

| Design Parameter | Preferred Value | Narrow Range | Broad Range |
|---|---|---|---|
| Le, mm | 55 | 45–60 | 10–70 |
| Lt, mm | 12 | 7–13 | 0–24 |
| $L_{D1}$, mm | 10 | 9–11 | 5–40 |
| $L_{D2}$, mm | 270 | 250–280 | at least 150 |
| θe, degrees | 10 | 8–15 | 4–45 |
| $\theta_{D1}$ degrees | 5 | 4–5 | 1–20 |
| $\theta_{D2}$, degrees | 0.54 | 0.1–0.9 | 0.0–5.0 |

$L_e$ represents the axial length of the inlet section 10. $L_t$ represents the axial length of the constant-area throat 12, $L_{D1}$ represents the axial length of first diverging section 14, and $L_{D2}$ represents the axial length of second diverging section 16.

Moreover, $\theta_e$ represents the converging angle between the nozzle wall of the inlet section 10 and the longitudinal axis 18 of the nozzle. Likewise, $\theta_{D1}$ is the average diverging angle between the nozzle wall of the first diverging section 14 and the longitudinal axis 18. $\theta_{D2}$ is the diverging angle between the nozzle wall of the second diverging section 16 and the longitudinal axis 18. It should be noted that the rate of divergence of the second diverging section 16 is generally less than that of the first diverging section 14.

FIG. 7 is a numerical table of radius vs. axial length for an exemplary nozzle according to the present invention.

It was noted above that a second diverging section of the nozzle was contemplated assuming frictionless airflow. Frictionless flow is generally a valid assumption when the conduit path is short in length, compared to diameter, and airspeed is relatively low. This, of course, is not the case here, since airspeed in the diverging sections is supersonic, and the length of nozzle is much longer than its diameter.

A Fanno-flow calculation was therefore performed in order to gauge the significance of frictional effects in the nozzle. It was found that frictional effects are significant for the nozzle according to the present invention, and must therefore be taken into account in designing the nozzle.

Accordingly, the supersonic portion of the nozzle must be diverged more quickly that required by inviscid flow. According to the present invention, the nozzle is therefore configured to maintain a constant gas Mach number therein, despite the aforementioned frictional effects. This constant Mach number is chosen so as to ensure that the relative Mach number between the airflow and the abrasive particles entrained therein will remain approximately 1.4 (i.e., within the general range of 1.07 to 1.84). Calculations show that a constant gas Mach number of 2.0 satisfies this requirement. From, for example, *Gas Dynamics,* 2nd. Ed., Prentice Hall, 1984, ch. 9, by J. John, it is known that the rate of change of nozzle diameter relative to axial distance along the nozzle equals:

$$\gamma M^2 f/4$$

where the ratio of specific heats, γ, equals 1.4 for air, M is the desired constant Mach number (i.e., 2.0), and f is a friction factor associated with the nozzle (0.0135 for present purposes). Accordingly, the nozzle should preferably diverge in second diverging section 16 at a rate of about 0.00945 mm of diameter per mm of axial length. This is equivalent to a divergence angle of about 0.5 degree relative to the longitudinal axis of the nozzle. This is reflected in Table 1 and FIGS. 5 and 7, above.

It can be appreciated that the nozzle diverges in proportion to the interior roughness of the nozzle, which may vary with material of fabrication.

In addition, friction reduces the stagnation pressure of the airflow through the diverging portion of the nozzle, so the actual exit pressure is less than 1.0 atm (i.e., it is not perfectly expanded). However, this is not currently considered a significantly detrimental issue.

Also, although the discussion of increased efficiency herein has been with respect 40-mesh steel grit, improvements are still possible with other materials, such as medium sand, slag abrasives, and fine mineral abrasives like staurolite. However, less massive particles are better accelerated in prior art nozzles, compared with 40-mesh steel grit, so the margins of improvement for them are not as great. For example, under the same considerations described above for 40-mesh steel grit, the exit kinetic energy for 30-mesh silica sand or coal slag is improved by about 75% to 80%. For fine mesh staurolite, the exit kinetic energy is improved by about 50%.

Finally, it is noted that nozzle throat diameter has not been specified according to the present invention since a variety of nozzle throat diameters are desirable (e.g. #3 to #12 in the environment described), and nozzle throat diameter does not affect particle acceleration through the nozzle as does the length of the diverging section of the nozzle. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A nozzle for use in an abrasive blast cleaning apparatus in which abrasive particles are entrained in an air stream, including:

a longitudinal axis;

a converging inlet section for receiving and the air stream and the entrained abrasive particles and being constructed and arranged to accelerate the air stream and the entrained abrasive particles;

a constant-area throat portion;

a first radially diverging section constructed and arranged to achieve a relative velocity between the abrasive particles and the air stream of approximately Mach 1.4; and a second radially diverging section having a rate of divergence less than that of said first diverging section and being constructed and arranged to increase a velocity of the air stream, such that said relative velocity between the abrasive particles and the air stream remains approximately Mach 1.4.

2. The nozzle of claim 1, wherein an axial length said inlet section is between 10 mm and 70 mm.

3. The nozzle of claim 2, wherein said axial length of said inlet section is between 45 mm and 60 mm.

4. The nozzle of claim 1, wherein an axial length of said throat section is between 0 mm and 24 mm.

5. The nozzle of claim 4, wherein said axial length of said inlet section is 55 mm.

6. The nozzle of claim 5, wherein said axial length of said throat section is between 7 mm and 13 mm.

7. The nozzle of claim 6, wherein said axial length of said throat section is 12 mm.

8. The nozzle of claim 1, wherein an axial length of said first diverging section is between 5 mm and 40 mm.

9. The nozzle of claim 8, wherein said axial length of said first diverging section is between 9 mm and 11 mm.

10. The nozzle of claim 9, wherein said axial length of said first diverging section is 10 mm.

11. The nozzle of claim 1, wherein an axial length of said second diverging section is at least 150 mm.

12. The nozzle of claim 11, wherein said axial length of said second diverging section is between 250 mm and 280 mm.

13. The nozzle of claim 12, wherein said axial length of said second diverging section is 270 mm.

14. The nozzle of claim 1, wherein an angle between the nozzle wall of said converging section and said longitudinal axis is between 4 and 45 degrees.

15. The nozzle of claim 14, wherein said angle between the nozzle wall of said converging section and said longitudinal axis is between 8 and 15 degrees.

16. The nozzle of claim 15, wherein said angle between the nozzle wall of said converging section and said longitudinal axis is 10 degrees.

17. The nozzle of claim 1, wherein an angle between the nozzle wall of said first diverging section and said longitudinal axis is between 1 and 20 degrees.

18. The nozzle of claim 17, wherein said angle between the nozzle wall of said first diverging section and said longitudinal axis is between 4 and 5 degrees.

19. The nozzle of claim 18, wherein said angle between the nozzle wall of said first diverging section and said longitudinal axis is 5 degrees.

20. The nozzle of claim 1, wherein an angle between the nozzle wall of said second diverging section and said longitudinal axis is between 0.0 and 5.0 degrees.

21. The nozzle of claim 20, wherein said angle between the nozzle wall of said second diverging section and said longitudinal axis is between 0.1 and 0.9 degrees.

22. The nozzle of claim 21, wherein said angle between the nozzle wall of said second diverging section and said longitudinal axis is 0.54 degrees.

23. The nozzle of claim 2, wherein an axial length of said throat section is between 0 mm and 24 mm.

24. The nozzle of claim 23, wherein an axial length of said first diverging section is between 5 mm and 40 mm.

25. The nozzle of claim 24, wherein an axial length of said second diverging section is at least 150 mm.

26. The nozzle of claim 25, wherein an angle between the nozzle wall of said converging section and said longitudinal axis is between 4 and 45 degrees.

27. The nozzle of claim 26, wherein an angle between the nozzle wall of said first diverging section and said longitudinal axis is between 1 and 20 degrees.

28. The nozzle of claim 27, wherein an angle between the nozzle wall of said second diverging section and said longitudinal axis is between 0.0 and 5.0. degrees.

* * * * *